US007594329B2

(12) United States Patent
Nuita

(10) Patent No.: US 7,594,329 B2
(45) **Date of Patent: *Sep. 29, 2009**

(54) HEAT INSULATION ROLLER AND MANUFACTURING METHOD THEREOF

(75) Inventor: Akira Nuita, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 730 days.

This patent is subject to a terminal disclaimer.

(21) Appl. No.: 11/079,385

(22) Filed: Mar. 15, 2005

(65) Prior Publication Data

US 2006/0207097 A1 Sep. 21, 2006

(51) Int. Cl.
*B21K 1/02* (2006.01)
*F28F 5/02* (2006.01)

(52) U.S. Cl. ..... 29/895.2; 492/46; 399/331

(58) Field of Classification Search ..... 492/46; 165/89, 104.21; 219/216, 469, 470; 399/331, 399/330, 334; 29/895, 895.2, 895.3
See application file for complete search history.

(56) References Cited

U.S. PATENT DOCUMENTS

| | | | | | |
|---|---|---|---|---|---|
| 3,336,648 | A * | 8/1967 | Alexeff | 492/4 |
| 3,720,808 | A * | 3/1973 | Morrissey | 219/469 |
| 3,965,334 | A * | 6/1976 | Asselman et al. | 219/399 |
| 4,064,933 | A * | 12/1977 | Schuman | 165/89 |
| 4,593,744 | A * | 6/1986 | Lewin et al. | 164/448 |
| 5,300,996 | A * | 4/1994 | Yokoyama et al. | 399/69 |
| 5,369,884 | A * | 12/1994 | Chen | 29/895.32 |
| 5,397,290 | A * | 3/1995 | Hellenthal | 492/46 |
| 5,773,796 | A * | 6/1998 | Singer et al. | 219/470 |
| 6,006,806 | A * | 12/1999 | Marschke | 156/472 |
| 6,100,508 | A * | 8/2000 | Kubik | 219/469 |
| 6,236,830 | B1 * | 5/2001 | Hoberock et al. | 399/330 |
| 6,675,876 | B2 * | 1/2004 | Yamashita et al. | 165/89 |
| 6,708,407 | B2 * | 3/2004 | Leinonen et al. | 29/895.32 |
| 6,821,237 | B1 * | 11/2004 | Isometsa et al. | 492/46 |
| 6,971,174 | B2 * | 12/2005 | Liu et al. | 29/895.21 |
| 7,097,605 | B2 * | 8/2006 | Zaoralek | 492/46 |
| 7,329,215 | B2 * | 2/2008 | Umeda | 492/46 |
| 7,362,995 | B2 * | 4/2008 | Nuita | 399/329 |
| 2003/0029603 | A1 * | 2/2003 | Yamashita et al. | 165/89 |
| 2003/0181303 | A1 * | 9/2003 | Leinonen et al. | 492/46 |

FOREIGN PATENT DOCUMENTS

JP 2004-109649 A 4/2004

OTHER PUBLICATIONS

U.S. Appl. No. 11/079,382, filed Mar. 15, 2005, Nuita.

* cited by examiner

*Primary Examiner*—Essama Omgba
(74) *Attorney, Agent, or Firm*—Foley & Lardner LLP

(57) ABSTRACT

A heat insulation roller of an image forming apparatus of the present invention arranges hollow pipes between a core roller and an outer peripheral roller and obtains a high heat insulating effect though it is light in weight and inexpensive. Further, the core roller and hollow pipes are inserted into the outer peripheral roller before pipe extension, and the outer peripheral roller is extended, and the hollow pipes are uniformly adhered and fixed between the core roller and the outer peripheral roller, and then the ends of the outer peripheral roller and hollow pipes are removed, thus the core roller can be secondarily worked easily.

11 Claims, 4 Drawing Sheets

HEAT INSULATION ROLLER AND MANUFACTURING METHOD THEREOF

FIELD OF THE INVENTION

The present invention relates to a heat insulation roller and a manufacturing method thereof used for various devices requiring temperature control such as a tension roller of a fixing belt of an image forming apparatus.

DESCRIPTION OF THE BACKGROUND

In an image forming apparatus such as an electro-photographic copying apparatus and a printer, in recent years, a belt type fixing apparatus has been developed. The belt type fixing apparatus can set a long fixing time, so that even in a color image composed of superimposed toners, a satisfactory fixing property can be obtained. Some belt type fixing apparatus stretches an endless fixing belt between a heating roller and a separation roller, heats the fixing belt by the heating roller, and inserts a sheet of paper through a nipper section between the fixing belt and a pressure roller to heat, pressurize, and fix a toner image. The fixing belt, to obtain high-speed and satisfactory fixing, is required to shorten the warming-up time and retain a predetermined fixing temperature. For the purpose, the separation roller is required to use a highly heat insulation roller to prevent the fixing belt from cooling when it makes contact with the fixing belt and furthermore is required to reduce the weight to realize compactness, lightweight, and energy conservation of the apparatus.

Conventionally, in Japanese Patent Application Publication No. 2004-109649, an apparatus having a plurality of heat pipes installed inside a central part of a core bar of a fixing roller is disclosed.

However, the pipes are structured so as to be installed inside the core bar and uniformly diffuse heat to the core bar. Namely, the pipes do not form a heat insulation structure between the hollows of the pipes and the core bar. Further, as a heat insulating separation roller, there are a roller composed of heat resistant silicone rubber or heat resistant sponge and a ceramic roller covered with a PFA (perfluoroalkyl vinyl ether) tube available. However, the heat resistant silicone rubber and heat resistant sponge have comparatively high thermal conductivity, thus a higher heat insulating effect cannot be obtained, and the warming-up time cannot be shortened. Furthermore, the ceramics roller produces a heat insulation effect by an air layer contained in ceramics, contributes to shortening of the warming-up time, though is difficult to ensure the manufacturing accuracy, requires a damage prevention measure, thereby is comparatively expensive.

Therefore, in the separation roller for driving the fixing belt, to prevent the fixing belt from loss of temperature, it is desired to use a heat insulation roller which is low in heat capacity, high in heat insulation, and light in weight, has a satisfactory fixing efficiency, and can obtain a fixed image of high image quality.

SUMMARY OF THE INVENTION

An object of the present invention is to provide a heat insulation roller which is light in weight and has a high heat insulation property and a manufacturing method thereof.

According to an embodiment of the present invention, there is provided an insulation roller comprising a core roller, an outer peripheral roller coaxial with the core roller, and a plurality of hollow pipes uniformly arranged in a gap between the core roller and the outer peripheral roller.

DETAILED DESCRIPTION OF THE INVENTION

Figure 1:
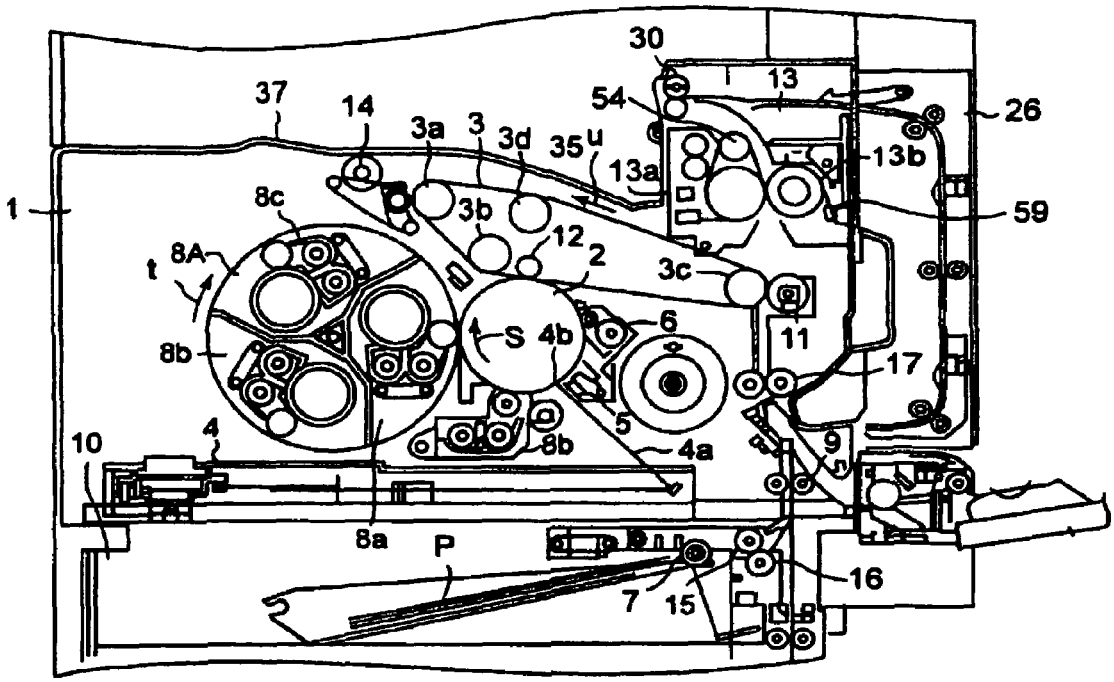
FIG. 1 is a schematic block diagram showing the image forming unit of the color image forming apparatus of the first embodiment of the present invention.

The first embodiment of the present invention will be explained in detail with reference to the accompanying drawings. FIG. 1 is a schematic block diagram showing image forming unit 1 and paper feed unit 10 of the color image forming apparatus of the embodiment of the present invention. Paper feed unit 10 takes out sheet of paper P by pick-up roller 7 from paper feed cassette 24 and feeds sheet of paper P toward resist roller 17 via separation roller 16 and conveying rollers 9.

Around photosensitive drum 2 of image forming unit 1, charger 5 for uniformly charging sequentially photosensitive drum 2 according to the rotation of photosensitive drum 2 in the direction of arrow s, irradiation position 4*b* of laser beam 4*a* from laser exposure apparatus 4 which is a latent image forming section for forming a latent image on charged photosensitive drum 2, black developing apparatus 8B, and color developing apparatus 8A of a revolver type for rotatably supporting developing devices 8*a*, 8*b*, and 8*c* for developing by developers of yellow (Y), magenta (M), and cyan (C) in the direction of arrow t.

Furthermore, around photosensitive drum 2, transfer belt unit 35 having an intermediate transfer belt 3, which is stretched and suspended by driving roller 3*c*, driven roller 3*a*, and tension rollers 3*b* and 3*d* and on which a toner image is primarily transferred on photosensitive drum 2 at the position of primary transfer roller 12, and a cleaner 6 are arranged. Intermediate transfer belt 3 has belt cleaner 14. Further, image forming apparatus 1 has secondary transfer roller 11 for secondarily transferring a toner image of a plurality of colors superimposed on intermediate transfer belt 3 onto sheet of paper P which is a recording medium, fixing apparatus 13 of a fixing belt type for fixing the toner image on sheet of paper P, paper ejection rollers 30 for ejecting sheet of paper P after fixing to paper ejection section 31, and reverse conveyor apparatus 26 for reversing sheet of paper P at the time of forming both-side images.

Figure 2:
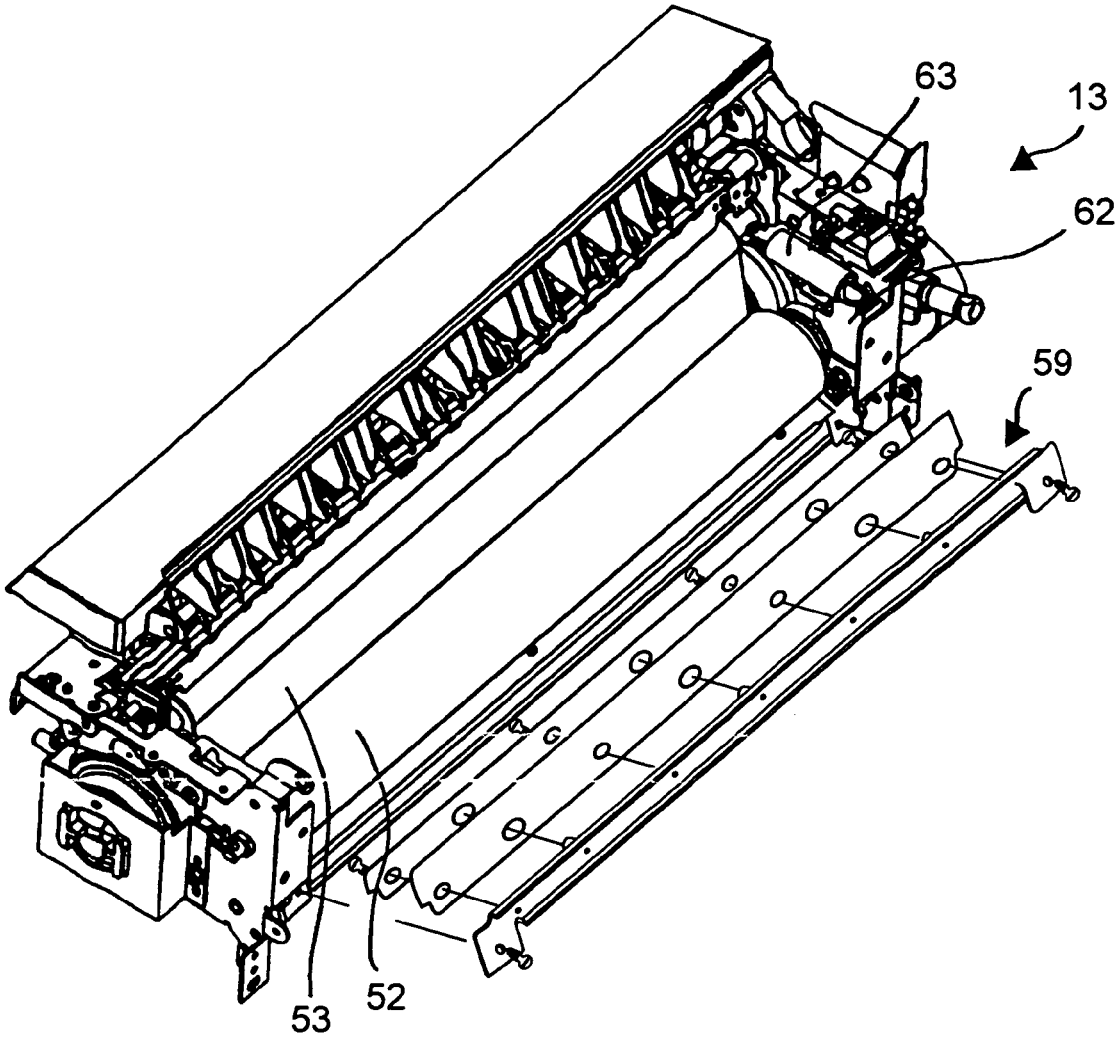
FIG. 2 is a schematic perspective view showing the fixing apparatus of the first embodiment of the present invention.
Figure 3:
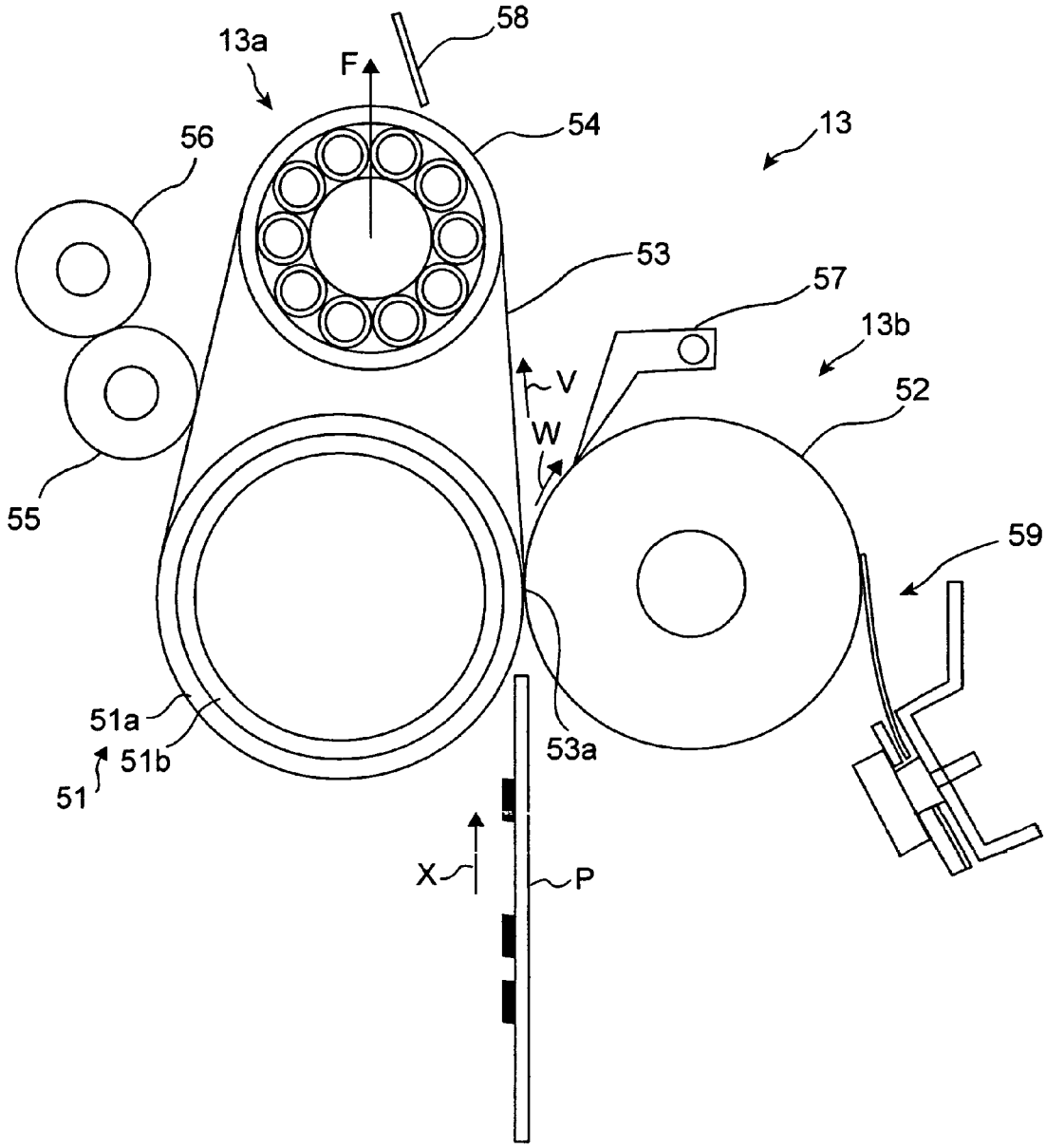
FIG. 3 is a schematic constitution view showing the fixing apparatus of the first embodiment of the present invention.
Figure 4:
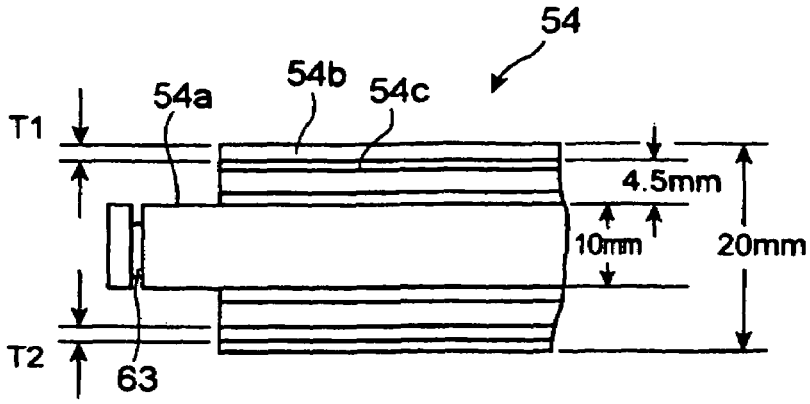
FIG. 4 is a schematic constitution view showing a part of the separation roller the first embodiment of the present invention.

Next, fixing apparatus 13 will be described. Fixing apparatus 13, as shown in FIGS. 2 to 4, has heating section 13*a* having fixing belt 53 suspended by heating roller 51 and separation roller 54 which is a heat insulation roller and driven by separation roller 54 to rotate in the direction of arrow v. Further, fixing apparatus 13 has pressure section 13*b* having pressure roller 52 pressed to heating roller 51 by pressure arm 62 and pressure spring 63 and rotated in the direction of arrow w at the same speed as that of fixing belt 53. By doing this, between fixing belt 53 supported by heating roller 51 and pressure roller 52, desired nipper section 53*a* is formed.

Heating roller 51 is composed of an iron pipe 51*a* with an outer diameter of 40 mm and a material thickness of 0.75 mm internally including electromagnetic induction coil 51*b* and is inductively heated. Separation roller 54 uses stainless steel (SUS304) of thermal conductivity of 16 W/m-K as a material. Separation roller 54 is composed of hollow pipes 54*c* with material thickness T2 of 0.3 mm and an outer diameter of 4.5 mm uniformly arranged between core roller 54*a* with an outer diameter of 10 mm and outer peripheral roller 54*b* with material thickness T1 of 0.5 mm and an outer diameter of 20 mm. Separation roller 54, since hollow pipes 54*c* are arranged between core roller 54*a* and outer peripheral roller 54*b* to provide a space, can be formed to a structural body of low heat capacity and can produce a high heat insulating effect. Separation roller 54 is pressed in the direction of arrow F so as to always give tension to fixing belt 53 and is driven to rotate by a driving motor not drawn. A1

Figure 5:
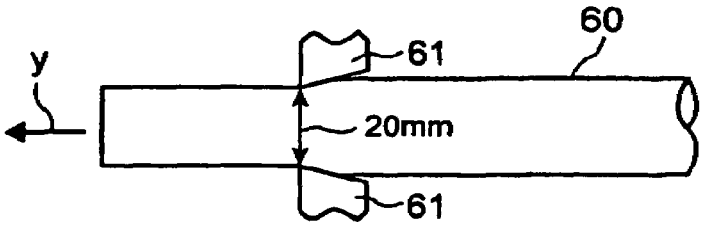
FIG. 5 is a schematic explanatory diagram showing the rolling process of the heat insulation roller base material of the first embodiment of the present invention.

Separation roller 54 is manufactured by the processes shown in FIGS. 5 to 8. Firstly, core roller 54*a* and hollow pipes 54*c* are inserted into pipe 60 having an outer diameter larger than that of core roller 54*a* by about 10% and then as shown in FIG. 5, pipe 60 is inserted into mouthpiece 61 drawn to an outer diameter of 20 mm, which is the size of separation roller 54, in the direction of arrow y so as to form long heat insulation roller base material 62. By doing this, hollow pipes 54*c* are adhered and fixed to the gap between core roller 54*a* and pipe 60.

Figure 6:
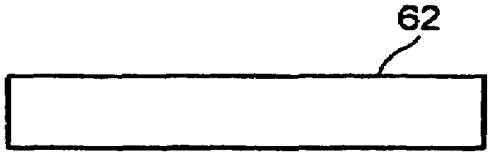
FIG. 6 is a schematic explanatory diagram showing the cut process of the heat insulation roller base material of the first embodiment of the present invention.
Figure 7:
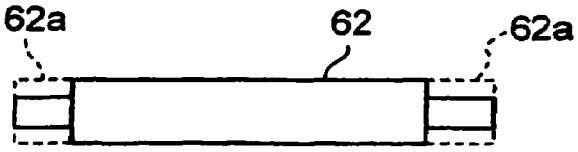
FIG. 7 is a schematic explanatory diagram showing the removal process of the outer peripheral roller and hollow pipes at both ends of the heat insulation roller base material of the first embodiment of the present invention.
Figure 8:
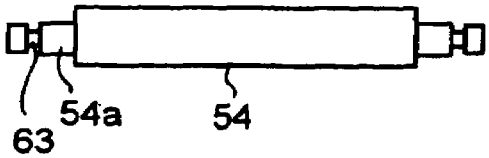
FIG. 8 is a schematic explanatory diagram showing the working process of the core roller of the heat insulation roller base material of the first embodiment of the present invention.

Next, as shown in FIG. 6, long heat insulation roller base material 62 is cut to the size of separation roller 54 by a cutter or a water jet. Thereafter, as shown in FIG. 7, only pipe 60 and hollow pipes 54*c* at both ends 62*a* of heat insulation roller base material 62 are removed so as to leave core roller 54*a* at both ends. Next, as shown in FIG. 8, slits 63 are bored at both ends of core roller 54*a* to form separation roller 54.

Fixing belt 53 is composed of a 3-layer belt of a nickel (Ni) substrate laminated with silicone rubber and PFA (perfluoroalkyl vinyl ether). With fixing belt 53, oil roller 55 for feeding oil onto the surface of fixing belt 53 is in contact. With oil roller 55, cleaning roller 56 for adhering and cleaning stains of the surface of oil roller 55 is in contact. Further, in the neighborhood of separation roller 54, separation plate 58 for preventing sheets of paper P from wrapping is installed.

Pressure roller 52 is composed of roller-shaped sponge with an outer diameter of 38 mm. Around pressure roller 52, separation pawl 57 for preventing sheets of paper P from wrapping and cleaning blade unit 59 for scraping and cleaning stains of the surface of the pressure roller are installed.

Next, the color image forming process by image forming unit 1 will be explained. Image forming unit 1 superimposes toner images in the order of black (BK), cyan (C), magenta (M), and yellow (Y) to form a color image.

When the image forming process starts, in fixing apparatus 13, heating roller 51 is heated by electromagnetic induction coil 51*b*, and fixing belt 53 is driven to rotate by separation roller 54 in the direction of arrow v, thus the warming-up is started. At this time, since separation roller 54 is a structural body of low heat capacity, fixing belt 53, when it makes contact with separation roller 54, is not taken greatly the heat given by heating roller 51. Therefore, fixing roller 53 can realize warming-up at high speed.

When the fixing roller 53 finishes the warming-up and is put into a ready state, intermediate transfer belt 3 is rotated in the direction of arrow u in correspondence with driving by photosensitive drum 2. Photosensitive drum 2 is uniformly charged by charger 5 according to the rotation in the direction of arrow s, is irradiated with laser beam 4*a* according to a black image signal by laser exposure apparatus 4 to form a black electrostatic latent image, which is developed by black developing apparatus 8B moved to the developing position.

The black (BK) toner image on photosensitive drum 2 is primarily transferred electrostatically onto intermediate transfer belt 3 rotating in the direction of arrow u at the position of primary transfer roller 12. After the primary transfer, photosensitive drum 2 is cleaned residual toner by cleaner 6.

Hereafter, similarly to the black (BK) toner image forming process, the toner image forming processes of cyan (C), magenta (M), and yellow (Y) are sequentially repeated, and toner images of a plurality of colors are superimposed at the same position on intermediate transfer belt 3, thus a full-color toner image is obtained on intermediate transfer belt 3. During this period, black developing apparatus 8B is separated from photosensitive drum 2 and color developing apparatus 8A rotates in the direction of arrow t according to arrival of electrostatic latent images of various colors, thereby arranges sequentially cyan (C) developing device 8*c*, magenta (M) developing device 8*b*, and yellow (Y) developing device 8*a* opposite to photosensitive drum 2.

Hereafter, the full-color toner images of black (BK), cyan (C), magenta (M), and yellow (Y) superimposed on intermediate transfer belt 3 are secondarily transferred onto sheet of paper P in a batch at the secondary transfer position opposite to secondary transfer roller 11. Sheet of paper P is conveyed to the secondary transfer position synchronously with arrival of the full-color toner images on intermediate transfer belt 3 at the secondary transfer position.

Sheet of paper P on which the full-color toner images are formed moves in the direction of arrow x, is conveyed to fixing apparatus 13, and is inserted through nipper section 53*a* between fixing belt 53 and pressure roller 52 to fully heat, pressurize, and fix the full-color toner images. Sheet of paper P passing through nipper section 53*a* is separated from fixing belt 53 by the stiffness thereof, is guided by separation plate 58, and is ejected from paper ejection roller 30 to paper ejection section 31. However, when sheet of paper P is wrapped in pressure roller 52, it is separated by separation pawl 57.

During this period, fixing belt 53 rotating in the direction of arrow v is heated by contact with heating roller 51 heated by electromagnetic induction coil 51*b*. By doing this, fixing belt 53, in nipper section 53*a* with pressure roller 52, is retained at the fixable temperature. Fixing belt 53, after passing nipper section 53*a*, makes contact with separation roller 54. However, separation roller 54 is a structural body of low heat capacity, so that fixing belt 53 is not taken greatly the heat. Therefore, fixing belt 53, after making contact with separation roller 54, reaches heating roller 51 once again in a state that it is almost kept in the heating state by heating roller 51 and is re-heated by heating roller 51. Further, toner adhered onto the surface of fixing belt 53 is removed by oil roller 55 and then oil roller 55 is cleaned by cleaning roller 56. Stains of pressure roller 52 are scraped by cleaning blade 59.

As mentioned above, in fixing apparatus 13, fixing belt 53 is not taken heat, though it makes contact with separation roller 54. Therefore, fixing belt 53 can be warmed up at high speed and can be kept at the fixable temperature.

Further, when the warming-up time of fixing belt 53 is tested using fixing apparatus 13, compared with a comparison example using a separation roller composed of a heat resistant silicone rubber roller with an outer diameter of 20 mm in an environment at a room temperature of 25° C., the warming-up time up to the fixing temperature 180° C. is improved by about 5%. Further, the weight of separation roller 54 of this embodiment is reduced by about 3% compared with comparison example 1.

According to the first embodiment, hollow pipes 54*c* are arranged between core roller 54*a* of separation roller 54 and outer peripheral roller 54*b*, so that separation roller 54 can be formed an a structural body of low heat capacity and although it is light in weight and inexpensive, the heat insulating effect can be increased. Therefore, when fixing belt 53 of fixing apparatus 13 is given tension and driven by such separation roller 54, although it makes contact with separation roller 54, the temperature reduction of the fixing belt can be made smaller and the warming-up can be speeded up. Further, during fixing, the surface temperature of fixing belt 53 can be easily kept at a predetermined fixable temperature and a fixed image of high image quality can be obtained by fixing belt 53.

Further, according to the first embodiment, during manufacturing of separation roller 54, core roller 54*a* and hollow pipes 54*c* are inserted into pipe 60, and pipe 60 is extended at both of its ends forming outer peripheral roller 54*b*, thus hollow pipes 54*c* can be uniformly adhered and fixed easily between core roller 54*a* and outer peripheral roller 54*b*. Thereafter, outer peripheral roller 54*b* and the ends of hollow pipes 54*c* are removed, thus forming of slit 63 which is secondary working of remaining core roller 54*a* can be executed easily, and highly heat insulating separation roller 54 can be manufactured easily. Further, material thickness T1 of outer peripheral roller 54*b* is larger than material thickness T2 of hollow pipes 54*c*, so that there is no fear that during rolling of outer peripheral roller 54*b*, the shape of hollow pipes 54*c* may adversely affect the shape of outer peripheral roller 54*b* and outer peripheral roller 54*b* having an even and smooth surface can be obtained easily.

Figure 9:
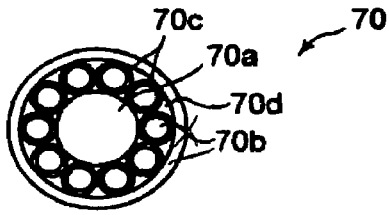
FIG. 9 is a cross sectional view showing the separation roller of the second embodiment of the present invention.

Next, the second embodiment of the present invention will be explained. The second embodiment is different from the first embodiment in the material and manufacturing process of the separation roller. Therefore, in the second embodiment, the same parts as those of the explained constitution of the first embodiment are assigned the same numerals and the explanation thereof will be omitted. In this embodiment, as shown in FIG. 9, separation roller 70 which is a heat insulation roller is manufactured. Through stainless steel core roller 70*a* with an outer diameter of 10 mm and thermal conductivity of 16 W/m-K, stainless steel outer peripheral roller 70*b* with material thickness T1 of 0.5 mm, an outer diameter of 20 mm, and thermal conductivity of 16 W/m-K is inserted.

Between core roller 70*a* and outer peripheral roller 70*b*, hollow pipes 70*c* with material thickness T2 of 0.3 mm and an outer diameter of 4.5 mm are uniformly inserted, and adhesive 70*d* is injected into the gap thereof to adhere and fix hollow pipes 70*c*, thus a long heat insulation roller base material is prepared. Hereafter, the long heat insulation roller base material is cut to the size of separation roller 70, and outer peripheral roller 70*b* and hollow pipes 70*c* at both ends are removed, and slits are bored at both ends of core roller 70*a*, and separation roller 70 is formed.

According to the second embodiment, similarly to the first embodiment, hollow pipes 70*c* are arranged between core roller 70*a* and outer peripheral roller 70*b* of separation roller 70, thus separation roller 70 can be formed an a structural body of low heat capacity and a heat insulation roller, although light in weight and inexpensive, realizing a high heat insulating effect can be obtained.

Further, the present invention is not limited to the aforementioned embodiments and can be variously changed within the scope of the present invention, and for example, the structure of an image forming apparatus loading the fixing apparatus using the heat insulation roller of the present invention is not limited, and an image forming apparatus of a tandem type arranging a plurality of photoconductor units in parallel is acceptable. Further, in the heat insulation roller, the material and material thickness thereof are not limited, and in the first embodiment, iron may be optionally used instead of stainless steel, though to retain the heat insulating property, a material of thermal conductivity of 90 W/m-K or less is preferably used.

Furthermore, to prevent the shape of the hollow pipes from affecting the outer peripheral roller, material thickness T2 of the hollow pipes is preferably equal to or smaller than material thickness T1 of the outer peripheral roller. Further, the structure of the heat insulation roller is optional, and the hollow pipes, if they are in a pipe shape, may be elliptic, and between the core roller and the outer peripheral roller, thin hollow pipes may be arranged in a plurality of stages. Furthermore, the core roller may be composed of a pipe instead of a solid roller. Further, the manufacturing process and use of the heat insulation roller are not limited.

As mentioned above, according to the present invention, between the core roller and the outer peripheral roller, the hollow pipes are arranged uniformly, so that a heat insulation roller which is light in weight and inexpensive can be obtained easily. Therefore, when such a heat insulation roller is used as a tension roller of the fixing belt, the fixing belt can be prevented from reduction in temperature, and the warming-up of the fixing apparatus can be speeded up, and a fixed image of high image quality can be obtained.

What is claimed is:

1. A heat insulation roller, comprising:

a core roller;

an outer peripheral roller coaxial with the core roller; and a plurality of hollow pipes uniformly arranged in a gap between the core roller and the outer peripheral roller, wherein the core roller, the outer peripheral roller, and the hollow pipes are structured so as to have thermal conductivity of 90 W/m-K or less.

2. A manufacturing method of a heat insulation roller, comprising:

fixing almost uniformly a plurality of hollow pipes in a gap between a core roller and an outer peripheral roller coaxial with the core roller;

removing ends of the outer peripheral roller and the hollow pipes except the core roller; and secondarily working the core roller, wherein the core roller, the outer peripheral roller, and the hollow pipes are structured so as to have thermal conductivity of 90 W/m-K or less.

3. The manufacturing method of a heat insulation roller according to claim 2, wherein the step of fixing the plurality of hollow pipes in the gap between the core roller and the outer peripheral roller is performed by inserting the core roller and the plurality of hollow pipes into a pipe, then, extending ends of the pipe, thereby adhering and fixing the hollow pipes in the gap between the core roller and the pipe such that the pipe becomes the outer peripheral roller.

4. The manufacturing method of a heat insulation roller according to claim 3, wherein the core roller, the outer peripheral roller, and the plurality of hollow pipes are composed of a metallic material.

5. The manufacturing method of a heat insulation roller according to claim 2, wherein the fixing the plurality of hollow pipes in the gap between the core roller and the outer peripheral roller inserts the plurality of hollow pipes into the gap between the core roller and the outer peripheral roller, then fills the gap with an adhesive, thereby adheres and fixes the hollow pipes in the gap between the core roller and the outer peripheral roller.

6. The manufacturing method of a heat insulation roller according to claim 2, wherein assuming a material thickness of the outer peripheral roller as T1 and a material thickness of the hollow pipes as T2, T1>T2.

7. A fixing device, comprising:

a fixing belt driven to rotate to make contact with a recording medium;

a heating member to heat the fixing belt; and a heat insulation roller to give tension to the fixing belt and support the fixing belt rotatably, wherein the heat insulation roller comprises a core roller, an outer peripheral roller coaxial with the core roller in contact with the fixing belt and a plurality of hollow pipes uniformly arranged in a gap between the core roller, and wherein the core roller, the outer peripheral roller, and the hollow pipes are structured so as to have thermal conductivity of 90 W/m-K or less.

8. The device according to claim 7, wherein the heating member is inductively heated.

9. The device according to claim 7, wherein the core roller is projected from ends of the outer peripheral roller and the hollow pipes.

10. The device according to claim 7, wherein the hollow pipes are adhered and fixed in the gap between the core roller and the outer peripheral roller.

11. The device according to claim 7, wherein the hollow pipes are adhered and fixed by an adhesive in the gap between the core roller and the outer peripheral roller.

* * * * *